United States Patent [19]

Hoy et al.

[11] Patent Number: 4,549,379

[45] Date of Patent: Oct. 29, 1985

[54] SKYLIGHT ASSEMBLY

[76] Inventors: Walter S. Hoy; Donald L. Roettele, both of 4518 Taylorsville Rd., Dayton, Ohio 45424

[21] Appl. No.: 464,651

[22] Filed: Feb. 7, 1983

[51] Int. Cl.[4] ..... E04B 7/18

[52] U.S. Cl. ..... 52/200; 52/788; 52/309.9

[58] Field of Search ..... 52/790, 200, 788, 72, 52/309.9

[56] References Cited

U.S. PATENT DOCUMENTS

| | | | |
|---|---|---|---|
| 3,417,527 | 12/1968 | Kiekhaefer | 52/200 |
| 3,434,250 | 3/1969 | Kiekhaefer | 52/200 |
| 4,073,097 | 2/1978 | Jentoft et al. . | |
| 4,193,237 | 3/1980 | Jankowski . | |
| 4,223,493 | 9/1980 | Moench | 52/200 |
| 4,296,578 | 10/1981 | Keckman | 52/200 |

*Primary Examiner*—John E. Murtagh
*Assistant Examiner*—Kathryn Ford
*Attorney, Agent, or Firm*—Jacox & Meckstroth

[57] ABSTRACT

A skylight unit includes a generally flat inner panel of light transmitting sheet plastics material, and the inner panel is covered by dome-shaped intermediate and outer panels of the light transmitting sheet plastics material. The outer peripheral edge portions of the panels are bonded together by a sealant material and by a frame of rigid foam plastics material, and the peripheral edge portion of the outer panel extends to cover the frame and to form a depending skirt portion which is bonded to the frame. The skylight unit is mounted on a curb unit which consists of a vacuum-formed sheet of plastics material having an upwardly projecting frame-shaped curb portion integrally connecting an outwardly projecting flashing portion to a downwardly projecting inner flange portion. The curb portion is filled with a rigid foam plastics material and receives threaded fasteners which extend horizontally into insert members embedded within the frame of the skylight unit.

11 Claims, 4 Drawing Figures

SKYLIGHT ASSEMBLY

BACKGROUND OF THE INVENTION

In the construction of skylight units adapted for installation on a sloping roof in covering relation to an opening formed within the roof, it is common for the skylight unit to incorporate one or more panels of light transmitting material such as glass or transparent sheet plastics material. The peripheral edge portions of the panels are attached and sealed to a rigid frame which is usually rectangular and may be formed of wood or metal, for example, as disclosed in U.S. Pat. No. 4,073,097. The opening within the sloping roof is usually defined by a rectangular frame of gypsum board or wood panels which are nailed to a rectangular wood frame projecting upwardly through the roof sheeting, for example, as disclosed in U.S. Pat. No. 4,193,237. The wood frame may be surrounded by a rectangular sheet metal flashing having flange portions projecting outwardly underneath the roofing materials. The wood frame and surrounding flashing form a rectangular frame-like curb which projects upwardly from the roof and supports the frame of the skylight unit.

It has been found that many conventional skylight assemblies develop water leaks after being installed for a period of time as a result of being exposed to a wide variation of weather conditions and being subjected to expansion and contraction due to substantial changes in temperature. In addition, many of the skylight assemblies do not provide high thermal insulation and frequently result in the formation of condensation which drips from the skylight assembly. Other forms of skylight assemblies are disclosed in U.S. Pat. Nos. 4,223,493 and 4,296,578.

SUMMARY OF THE INVENTION

The present invention is directed to an improved and simplified skylight unit which solves the problems mentioned above by effectively eliminating any problems of leaking and formation of condensation. The skylight unit of the invention also provides high thermal insulation any may be quickly installed within a sloping or flat roof. In general, these features are provided by a skylight unit which incorporates a set of light transmitting panels supported by a frame of rigid plastics foam material. The outer panel has a peripheral edge portion which encases the frame, and anchor strips are embedded within the frame for receiving retaining screws.

The skylight unit of the invention is adapted to be mounted on an improved curb unit which also provides for a leak-proof and condensation-proof installation and which may also be quickly installed within a roof. The curb unit incorporates a vacuum formed sheet of relatively rigid sheet plastics material and includes an upwardly projecting frame-like curb portion which integrally connects an outwardly projecting plannar flashing portion to a downwardly projecting inner mounting flange portion. The curb portion of the vacuum formed sheet is filled with a rigid plastics foam material to provide rigidity and thermal insulation. The curb portion also has peripherally spaced prelocated holes for receiving the retaining screws which extend through the curb portion and into the anchor strips embedded within the frame of the skylight unit.

Other features and advantages of the invention will be apparent from the following description, the accompanying drawing and the appended claims.

DESCRIPTION OF THE PREFERRED EMBODIMENTS

Figure 1:
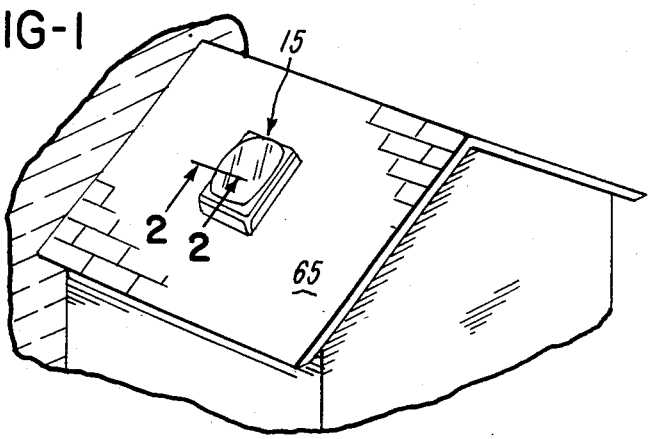
FIG. 1 is a perspective view of a skylight unit and curb unit constructed in accordance with the invention and illustrating their installation on a sloping roof.
Figure 4:
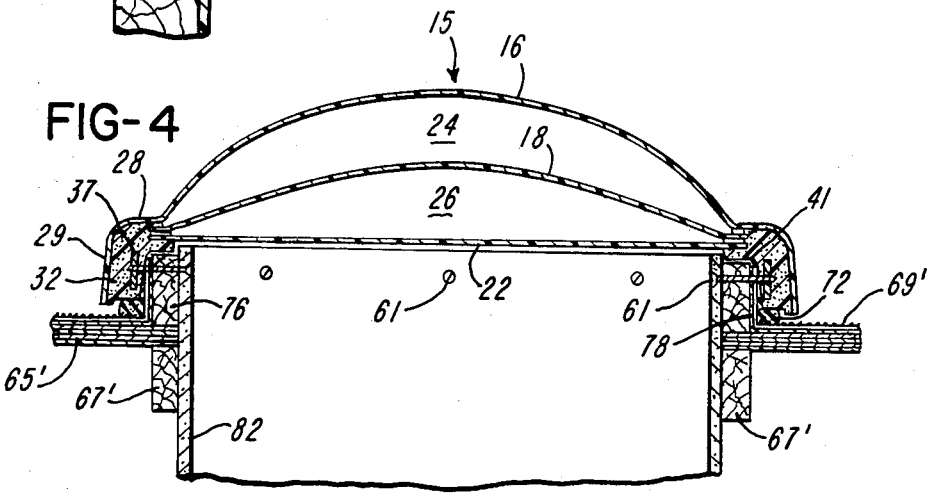
FIG. 4 is a full section of the skylight unit shown in FIGS. 1–3 and assembled on a conventional curb structure forming a skylight opening within a roof.

The skylight unit 15 shown in FIG. 1 includes a vacuum and heat-formed outer panel 16, a similarly formed intermediate panel 18, and an inner panel 22. Each of the panels is formed from a sheet of transparent plastics material such as an acrylic or polycarbonate sheet. As shown in FIG. 4, the outer panel 16 and the intermediate panel 18 each have a dome-shaped center portion and define a dome-shaped air space 24 therebetween. The inner panel 22 is flat and cooperates with the intermediate panel 18 to define another air space 26.

The outer panel 16 has a peripheral edge portion 28 which projects laterally outwardly and then downwardly to form a depending skirt 29. The peripherally extending edge portion 28, including the skirt 29, receives foamed-in-place generally rectangular frame 32 of expanded rigid plastics foam material such as a polyurethane foam which bonds to the edge portion 28 and to the edge portions of the panels 18 and 22. The frame 32 includes a portion 33 which projects inwardly and supports the peripheral edge portions of the transparent panels 18 and 22 which project outwardly under the peripheral edge portion 28 of the outer panel 16. An adhesive sealant material 34, such as a double sided foamed adhesive tape, forms a fluid-tight bond between the peripheral edge portions of the panels 18 and 22 and also with the peripheral edge portion 28 of the outer panel 16. A series of peripherally spaced sections or strips 37 of anchor material such as higher density polyurethane strips or plywood strips are embedded within the rigid foam plastic frame 32 and are adapted to receive a series of screws, as will be explained later. The inner surface of the edge portion 28 of the outer panel 16 is coated with an opaque material before the frame 32 is bonded to the edge portion 28.

Figure 2:
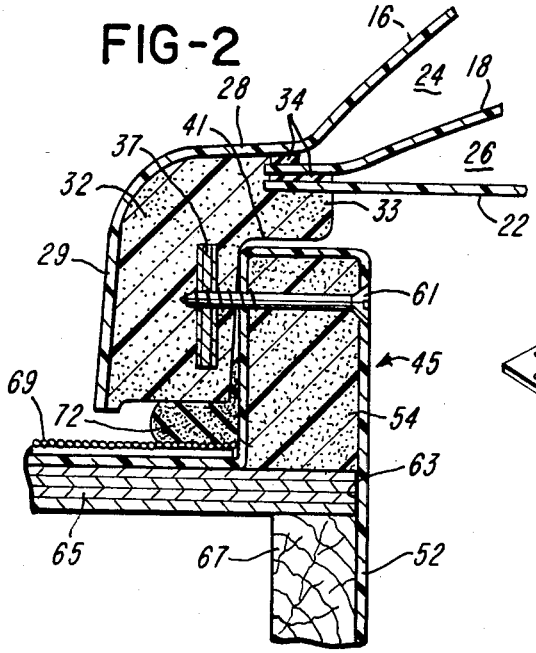
FIG. 2 is an enlarged fragmentary cross-section as taken generally on the line 2—2 of FIG. 1.
Figure 3:
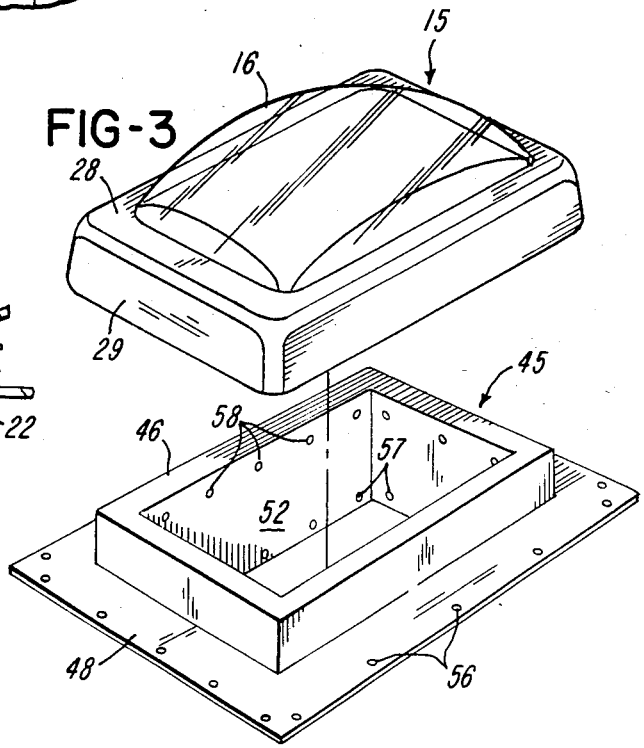
FIG. 3 is an exploded perspective view of the skylight unit and the curb unit shown in cross-section in FIG. 2.

The frame 32 of the skylight unit 15 defines a peripherally extending inner recess 41 which is adapted to receive a rectangular frame-like curb unit 45 (FIG. 3) also constructed in accordance with the invention. The curb unit 45 is produced by vacuum forming a sheet of semi-rigid plastics material such as vinyl, and includes a frame-shaped curb portion 46 which integrally connects a laterally or outwardly projecting flashing portion 48 with a downwardly projecting rectangular mounting flange portion 52. As shown in FIG. 2, the curb portion 46 has a rectangular cross-sectional configuration and is filled with an expanded rigid plastics foam material 54 such as the rigid polyurethane foam used to form the frame 32 of the skylight unit 15. The flashing portion 48 of the curb unit 45 is provided with peripherally spaced holes 56, and the mounting flange portion 52 is provided with peripherally spaced holes 57. Another series of peripherally spaced holes 58 are formed within the curb portion 46 and are adapted to receive a series of threaded fasteners or screws 61 which extend through the holes 58 and into the sections or strips 37 embedded within the frame 32 for securing the skylight unit 15 to the curb unit 45.

The curb unit 45 is adapted to be installed within a rectangular opening 63 (FIG. 2) formed within a roof deck or sheeting 65 after a rectangular wooden frame 67 is constructed within the roof under the sheeting 65. The sides of the frame 67 may be the rafters within the roof or may be a special frame constructed within the roof. The curb unit 45 is positioned so that the rigid foam frame 54 seats on the roof deck or sheeting 65, and the flashing portion 48 of the curb unit 45 projects outwardly under the shingles or roofing material 69. The mounting flange portion 52 projects downwardly through the opening 63 and is secured to the rafters or frame 67 by fasteners or nails driven through the holes 57. A bead of caulking or sealant material 72 extends around the curb unit 45 and is engaged by the rigid foam frame 32 of the skylight unit 15 to form a water and air tight seal between the skylight unit 15 and the curb unit 45. After the skylight unit is mounted on the curb unit, the screws 61 are inserted as mentioned above.

Referring to FIG. 4, the skylight unit 15 is also adapted to mount on a conventional curb assembly constructed within a rectangular opening 63' formed within a roof deck or sheeting 65'. As mentioned above, the conventional curb assembly commonly includes the construction of a wood 2×4 frame 76 which projects upwardly from the roof sheeting 65' and an L-shaped metal flashing 78 extends around the frame 76 and projects outwardly under the shingles or roofing material 69'. Sheets 82 of gypsum material or drywall form a rectangular frame within the opening 63' and are nailed to the upper frame member 76 and the lower frame members or rafters 67'. A series of screws 61 extend through the drywall and frame members 76 and metal flashing 78 for engaging the embedded anchor strips 37 within the frame 32 of the skylight unit 15.

From the drawing of the above description, it is apparent that a skylight unit and curb unit constructed in accordance with the present invention, provide desirable features and advantages. As one primary feature, both the skylight unit 15 and the curb unit 45 provide for a leak-proof and condensation-proof assembly. That is, the skylight unit 15 is adapted to accommodate expansion and contraction with substantial changes in temperature while maintaining a positive fluid-tight seal between the frame 32 of the skylight unit and the curb unit 45. As another important feature, the expanded rigid foam frame 32 of the skylight unit 15 and the expanded rigid foam 54 within the curb unit 45 cooperate with the multiple transparent panels to provide for high thermal insulation to minimize heat loss in the winter and heat gain within the summer. The curb unit 45 is also adapted to be conveniently and quickly installed within an opening formed within roof sheeting, and the continuous vacuum-formed sheet of plastics material forming the curb unit 45 not only assures against water leaks but forms a thermal barrier to prevent the forming of condensation and the dripping of the condensation from the curb unit into the room or space below.

While the form of skylight assembly herein described constitutes a preferred embodiment of the invention, it is to be understood that the invention is not limited to this precise form of assembly, and that changes may be made therein without departing from the scope and spirit of the invention as defined in the appended claims.

The invention having thus been described, the following is claimed:

1. A skylight assembly comprising an outer panel of light transmitting sheet material, a inner panel of light transmitting sheet material, said inner and outer panels having corresponding outer peripheral edge portions, means including a frame of substantially rigid plastics foam material for connecting said outer peripheral edge portions of said inner and outer panels and for forming a fluid-tight seal therebetween, said peripheral edge portion of said outer panel extending around said frame in covering relation and forming a peripheral skirt portion depending downwardly around said frame, said frame defining an inner peripherally extending recess adapted to receive a correspondingly shaped curb member projecting upwardly from a roof surface around a skylight opening within the roof, the members embedded within said foam material for receiving threaded fasteners extending through the curb member for securing said frame to the curb member.

2. A skylight assembly for covering a skylight opening within a roof surface, said assembly comprising an outer panel of light transmitting sheet material, an inner panel of light transmitting sheet material, said inner and outer panels having corresponding outer peripheral edge portions, a frame of rigid plastics foam material connecting said outer peripheral edge portions of said inner and outer panels and forming a fluid-tight seal therebetween, said peripheral edge portion of said outer panel extending around said frame in covering relation and forming a peripheral skirt portion depending downwardly around said frame, a curb member secured to said roof surface and projecting upwardly around said skylight opening, said frame defining an inner peripherally extending recess receiving a substantial portion of said curb member and projecting downwardly around said curb member to generally said roof surface, means for securing said frame to said curb member, and sealing means forming a fluid-tight seal between said roof surface and said frame of rigid plastics foam material.

3. A skylight assembly as defined in claim 2 wherein said frame of plastics foam material is bonded to said peripheral edge portions of said inner and outer panels.

4. A skylight assembly as defined in claim 2 and including an intermediate panel of light transmitting sheet material disposed between said inner and outer panels, said intermediate panel having a peripheral edge portion, and means forming a fluid-tight connection between said frame and said peripheral edge portion of said intermediate sheet.

5. A skylight assembly as defined in claim 4 wherein said outer panel and said intermediate panel are each dome-shaped and define a dome-shaped air space therebetween, and said frame includes a rigid foam portion projecting under the peripheral edge portions of said inner and intermediate panels.

6. A skylight assembly for covering a skylight opening within a roof surface, said assembly comprising a skylight unit including an outer panel of light transmitting sheet material and an inner panel of light transmitting sheet material, said inner and outer panels having corresponding outer peripheral edge portions, means including a frame for connecting said outer peripheral edge portions of said inner and outer panels and for forming a fluid-tight seal therebetween, said frame defining an inner peripherally extending recess, a frame-shaped curb unit projecting upwardly into said recess and mounted on the roof surface around the skylight opening, said curb unit including a single sheet of plastics material having a substantially uniform thickness and forming a frame-shaped curb portion having an inverted U-shaped cross-sectional configuration, said single sheet of plastics material also forming a peripherally extending flashing portion projecting laterally outwardly from the bottom of said curb portion, said single sheet of plastics material further forming a peripherally extending inner flange portion projecting downwardly from said curb portion and spaced inwardly of said flashing portion, and said curb portion forming the only integral seamless connection of said flashing portion to said inner flange portion around the entire periphery of said curb unit.

7. A skylight assembly as defined in claim 6 wherein said curb portion is also generally rectangular in cross-sectional configuration and encloses a substantially rigid foam plastics material which extends continuously within said curb portion.

8. A skylight assembly as defined in claim 7 wherein said curb portion of said curb unit and said foam plastics material is adapted to receive threaded fasteners extending laterally through said curb portion of said curb unit into said frame of said skylight unit.

9. A skylight assembly as defined in claim 6 wherein said frame of said skylight unit comprises a rigid foam plastics material, and said outer panel includes a peripheral skirt portion depending downwardly around said frame and bonded to said frame.

10. A skylight assembly as defined in claim 9 and including means embedded within said foam plastics material forming said frame for receiving threaded fasteners extending laterally through said curb portion.

11. A skylight assembly as defined in claim 6 wherein said single sheet of plastics material comprises a heat and pressure deformed rectangular sheet having a substantially uniform thickness.

* * * * *